US009127401B2

(12) United States Patent
Li et al.

(10) Patent No.: US 9,127,401 B2
(45) Date of Patent: Sep. 8, 2015

(54) WOOD PULP TREATMENT

(71) Applicant: UNIVERSITY OF NEW BRUNSWICK, Fredericton (CA)

(72) Inventors: Kecheng Li, Fredericton (CA); Andre Pelletier, Fredericton (CA); Yu Zhao, Fredericton (CA)

(73) Assignee: UNIVERSITY OF NEW BRUNSWICK, Fredericton, ON (CA)

( * ) Notice: Subject to any disclaimer, the term of this patent is extended or adjusted under 35 U.S.C. 154(b) by 0 days.

(21) Appl. No.: 13/755,663

(22) Filed: Jan. 31, 2013

(65) Prior Publication Data

US 2014/0209259 A1 Jul. 31, 2014

(51) Int. Cl.

| | |
|---|---|
| ***D21B 1/14*** | (2006.01) |
| ***D21C 9/00*** | (2006.01) |
| ***D21C 5/00*** | (2006.01) |

(52) U.S. Cl.
CPC *D21C 9/005* (2013.01); *D21B 1/14* (2013.01); *D21C 5/005* (2013.01)

(58) Field of Classification Search
USPC ..... 162/9
See application file for complete search history.

(56) References Cited

U.S. PATENT DOCUMENTS

| | | | | |
|---|---|---|---|---|
| 5,169,497 | A | 12/1992 | Sarkar et al. | |
| 5,725,732 | A | 3/1998 | Cooper et al. | |
| 5,750,005 | A | 5/1998 | Akhtar | |
| 5,813,617 | A | 9/1998 | Thoma | |
| 5,865,949 | A | 2/1999 | Pere et al. | |
| 5,874,293 | A | 2/1999 | Miettinen-Oinonen et al. | |
| 5,922,579 | A | 7/1999 | Fagerstrom et al. | |
| 6,099,688 | A | 8/2000 | Pere et al. | |
| 6,146,494 | A | 11/2000 | Seger et al. | |
| 6,267,841 | B1 | 7/2001 | Burton et al. | |
| 6,287,708 | B1 * | 9/2001 | Viikari et al. | 428/535 |
| 7,008,505 | B2 | 3/2006 | Akhtar et al. | |
| 7,922,705 | B2 | 4/2011 | Ampulski | |
| 8,394,237 | B2 | 3/2013 | Klein | |
| 2005/0000666 | A1 | 1/2005 | Taylor et al. | |
| 2005/0181485 | A1 | 8/2005 | Tsukamoto et al. | |
| 2007/0029059 | A1 | 2/2007 | Elgarhy et al. | |
| 2007/0151683 | A1 * | 7/2007 | Pere et al. | 162/72 |

(Continued)

FOREIGN PATENT DOCUMENTS

| | | |
|---|---|---|
| CA | 758488 | 5/1967 |
| CA | 2030836 A1 | 5/1991 |

(Continued)

OTHER PUBLICATIONS

J. D. Richardson et al., "Modification of Mechanical Pulp using Carbohydrate-Degrading Enzyme", J. Pulp Paper Sci. 24(4): 125-129 (1998).

(Continued)

*Primary Examiner* — Jacob Thomas Minskey
(74) *Attorney, Agent, or Firm* — Lynn C. Schumacher; Hill & Schumacher

(57) ABSTRACT

A process using a multicomponent enzyme preparation to treat screened once refined pulps and reduces the specific energy consumption and/or increasing production while maintaining or increasing handsheet physical properties. The enzyme preparation has a major endoglucanase activity, a significant mannanase activity and a relatively small cellobiohydrolase activity. This enzyme mixture is prepared from a genetically modified strain of *Trichoderma reseii*.

14 Claims, 4 Drawing Sheets

(56) References Cited

U.S. PATENT DOCUMENTS

| | | | |
|---|---|---|---|
| 2009/0117634 | A1 | 5/2009 | Bradley et al. |
| 2011/0168344 | A1 | 7/2011 | Klein et al. |
| 2011/0250638 | A1 | 10/2011 | Sjoede et al. |
| 2014/0106407 | A1 | 4/2014 | Zhu et al. |
| 2014/0209260 | A1 | 7/2014 | Li et al. |

FOREIGN PATENT DOCUMENTS

| | | | |
|---|---|---|---|
| CA | 2109111 | | 10/1992 |
| EP | 1699974 | | 7/2009 |
| WO | 9628606 | | 9/1996 |
| WO | 9740194 | | 10/1997 |
| WO | 2005/056915 | A1 | 6/2005 |
| WO | 2011130503 | A2 | 10/2011 |

OTHER PUBLICATIONS

A. C. Engstrom et al., "Improved Accessibility and Reactivity of Dissolving Pulp for the Viscose Process, Pretreatment with Monocomponent Endoglucanase", Biomacromolecules 7(6): 2027-2031, Jun. 2006.

T. M. Wood et al., "Mechanism of Fungal Cellulase Action", Biochem. J. 260: 37-43 (1989).

J. Pere et al., "Biomechanical Pulping with Enzymes: Response of Coarse Mechanical Pulp to Enzymatic Modification and Secondary Refining", Tappi Journal 83(5): 1-8, May 2000.

Ghose, T.K, "Measurement of Cellulase Activities", Pure & Appl. Chem. vol. 69, No. 2, pp. 257-268, 1987.

Ratto, M. and Poutanen, K., "Production of Mannan-Degrading Enzymes", Biotechnology Letters, vol. 10, No. 9, pp. 661-664, 1988.

Miller, G.L., "Use of dinitrosalicylic Acid Reagent for Determination of Reducing Sugar", Analytical Chem., vol. 31, No. 3, pp. 426-428, Mar. 1959.

Broda, P., "Biotechnology in the degradation and utilization of lignocellulose", Biodegradation 3:219-238 1992.

Kovacs, K. et al., (Krisztina Kovacs, Stefano Macrelli, George Szakacs and Guido Zacchi, "Enzymatic hydrolysis of steam-pretreated lignocellulosic materials with Trichoderma atroviride enzymes produced in-house" Biotechnology for Biofuels. Biotechnology for Biofuels 2009, 2:14).

Novozymes, Cellulclast® 1.5 Product Data Sheet, Mar. 9, 2009, Novozymes, pp. 1-2.

* cited by examiner

WOOD PULP TREATMENT

FIELD

The present invention relates to a treatment for mechanical wood pulp that improves its characteristics during downstream processing.

BACKGROUND OF THE INVENTION

Wood pulps are generally produced through multistep processes. Initially, logs can be subjected to grinding in which the logs are forced against a rotating abrasive stone which separates the fibers from the log and also the wood cell matrix. In a refining process, wood chips are fed between two metal discs, with at least one disc rotating. In both cases, essentially all of the constituents of wood are retained in the pulp that is eventually produced. Such pulp contains fiber bundles, fiber fragments and whole fibers. A lack of uniformity of pulp and constituents and the presence of lignin in the pulp give it certain desirable qualities, such as yield, paper bulk and opacity as well as good printability. The pulp also has less desirable properties for some paper types, such as low strength, relatively coarse surface and a lack of durability.

Chips to be refined can be destructured and impregnated with chemicals or enzymes prior to further mechanical treatment. This can help increase pulp quality or reduce energy consumption. These methods create slightly different pulps and also vary with the species of wood, quality of the wood, processing conditions and the amount of energy applied. Various forms exist: thermomechanical pulping (TMP), refiner pulping, stone groundwood pulping, etc.

In TMP, steam is added to the chips being refined to facilitate pulping and lower electricity consumption. Steam is also produced during refining and heat recovery systems can help recoup some of the energy cost of the process. The electric motors used to operate these refiners require very large amounts of power. The TMP process generally involves several refining stages to produce a desirable pulp. However, only a small portion of the energy used in each refining stage is actually used to separate and develop the fibers. Screening is used after or between refining stages to separate adequately refined fibers from longer, coarser fibers. These tougher fibers are sent to "rejects" refiners for further development. Depending on the quality of refining, the amount of rejects needing additional refining can be and usually is significant.

Woody biomass used in these mechanical pulping processes contains cellulose, hemicelluloses, lignin and extractives in varying amounts throughout the ultrastructure of its fibers. These various components act in conjunction to give these substrates mechanical strength and resistance to degradation. By selectively removing or altering certain components, it is possible to reduce the amount of energy required to separate and refine these fibers. The patent literature describes various approaches using different enzyme mixtures. For example US Patent Publication No. 2005/0000666, of Taylor et al., describes the use of mannanase and xylanase. Certain treatments have been found to significantly impact paper strength properties which have limited their applications. U.S. Pat. No. 5,865,949, of Pere et al., describes a process using an enzyme mixture containing endo-β-glucanase (EG), a limited mannanase and cellobiohydrolase (CBH) activity which reduces the negative effects on paper strength. U.S. Pat. No. 6,099,688, of Pere et al., describes the use of isolated cellobiohydrolase to increase the amount of relative amorphousness of the cellulose within the fibers. This process is said to cause even less damage to paper properties.

SUMMARY

The invention provides a method for preparing e.g., manufacturing a wood pulp. The pulp is prepared by exposing a mechanical wood pulp to an enzymatic solution containing an endoglucanase (EG) and a cellbiohydrolase (CBH), the ratio of enzymatic activities of the EG:CBH being at least 3.

It has been found that it is possible to carry out the treatment for an amount of time that results in a reduction of energy consumption during subsequent refining of the exposed pulp in which the freeness of the pulp (CSF) is reduced by at least 10% in comparison to the freeness of the same pulp which has not been exposed to the enzymatic solution while at least maintaining the tensile strength of a handsheet produced from the subsequently refined pulp in comparison with a handsheet produced from the same pulp which has not been exposed to the enzymatic solution. By maintaining tensile strength here is meant that the tensile index for the handsheet of treated material is at least 95% of that of the handsheet from untreated material, more preferably at least 96%, 97%, 98% or 99%.

The pulp to be treated can be pulp that has been mechanically refined, once, twice or more prior to the enzymatic treatment. The pulp can be a raw wood pulp. The pulp can also be a reject pulp containing a long-fiber fraction that makes it unsuitable for e.g., papermaking without further treatment, that can benefit from the treatment prior to further processing. Here, "long-fiber fraction" refers to R14 and P14/R30. R14 are fibers retained on a 14-mesh screen and P14/R30 pass through the 14-mesh screen but are retained on a 30 mesh screen.

The reduction in energy can be 5% or more. It can be 6%, 7%, 8%, 9%, 10%, 11%, 12%, 13%, 14%, 15%, 16%, 17%, 18%, 19%, 20%, 21%, 22% or more.

As mentioned, one possible measure of the benefit of treatment can be determined by processing the treated pulp by further refining and preparation of handsheet, and comparing properties of the handsheet with one prepared from the same pulp that has not been treated. In the case of tensile strength, such determination can be made according to TAPPI standard T 205 sp-06.

In another embodiment, the invention provides a method for producing a wood pulp, by exposing a wood pulp that has been refined at least once and having a long-fiber fraction containing wood fibers having a length of from 1 to 7 mm to an enzymatic solution. The pulp can be e.g., screened fraction of a refined pulp. The exposure time can be selected to reduce the average fiber length by between 5% and 25%. A more likely range of reduction would be between 10% and 20%, and could be about 10%, about 11%, about 12%, about 13%, about 14%, about 15%, about 16%, about 17%, about 18%, about 19% or about 20%, or up to any of these amounts. This reduction in fiber length can also be accompanied by the benefit of a reduction of energy consumption in a subsequent refining step of the enzymatically treated pulp.

The enzymatic treatment can be part of a larger process such as the manufacture of cardboard, paper towels, newspaper, hygiene products, etc.

The wood pulp treated in the enzymatic step can have a CSF of greater than 650 ml and be exposed to the enzymatic solution for time sufficient to reduce the drainability to less than 150. The initial CSF can also be greater than or about 220 ml, about 250 ml, about 300 ml, about 350 ml, about 400 ml, about 450 ml, about 500 ml, about 550 ml, or about 600 ml with the drainability of the treated pulp being less than or about 160 ml, about 170 or about 180 ml.

The enzymatic solution contains at least the aforementioned EG and CBH, and preferably also contains mannanase (MAN). The activity of the EG relative to the CBH is always significantly greater i.e., the ratio of activities of the EG:CBH are at least 3:1, but can be at least any of 4:1, 5:1, 6:1, 7:1, 8:1, 9:1, more preferably at least 10:1, 11:1 or 12:1. The activity of MAN is also greater than CBH, activity ratio MAN:CBH being at least 1.5:1, or at least any of 1.6:1, 1.7:1, 1.8:1, 1.9:1 or 2:1.

A measure of the enzymatic activities contained in a pulp treatment solution is, in practice, made relative to the substrate being treated. In the case of e.g., a fraction containing wood fibers having a length of from 1 to 7 mm, activity can be determined based on dry weight measured according to standard T 258 om-06.

The enzymatic activity of the EG is in the range of 0.5 to 25 CMCU per gm of wood substrate, but can be about any of 1, 2, 3, 4, 5, 6, 7, 8, 9, 9, 11, 12, 13, 14, 15, 16, 17, 18, 19, 20, 20, 21, 22, 23, or 24 CMCU per gm of wood substrate. Dry weight is measured according to standard T 258 om-06.

The enzymatic activity of the hemicellulase, mannanase is at least 1.5 times the activity of the CBH, and is typically at least 0.05 FPU per gm of wood fiber substrate. The long-fiber fraction based on dry weight measured according to standard T 258 om-06.

The enzymatic activity of the CBH, which is always lower than the activities of the EG and MAN, as described above, is typically at least 0.05 FPU per gm of the wood fiber substrate e.g., long-fiber fraction of the wood pulp being treated, again based on dry weight measured according to standard T 258 om-06. Enzymatic activity of CBH can be from 0.05 to 10 FPU, but is preferably between 0.1 and 3 FPU/g of wood on a dry weight basis.

An embodiment of the invention includes exposing mechanical wood pulp to an enzymatic solution for a sufficient length of time such that the amount of fines in a subsequently refined pulp is increased by at least 10% in comparison to subsequently refined pulp which has not been exposed to the enzymatic solution. Fines are measured according to standard TAPPI T-261. This increase in fines can also be accompanied by the benefit of a reduction of energy consumption in a subsequent refining step of the enzymatically treated pulp.

In another embodiment, the invention includes exposing mechanical wood pulp to an enzymatic solution for a sufficient length of time such that handsheet density of a handsheet produced from said subsequently refined pulp is increased by at least 5% in comparison to the handsheet density of a handsheet produced from the same pulp which has not been exposed to the enzymatic solution. Handsheet density is determined according to standard TAPPI T 220 sp-06. This comparative increase in handsheet density can also be accompanied by the benefit of a reduction of energy consumption in a subsequent refining step of the enzymatically treated pulp.

According to another embodiment, mechanical wood pulp is exposed to the enzymatic solution for a length of time selected to preclude the change in tear index of a handsheet produced from said subsequently refined pulp to no more than a decrease of 15% in comparison to the tear index of a handsheet produced from the same pulp which has not been exposed to the enzymatic solution. By this is meant that the tear index of a handsheet can increase or be the same, but if it decreases, it decreases no more than 15% with respect to the comparative sheet. Tear index of a handsheet is determined according to standard TAPPI T 414 om-12.

In yet another embodiment, a mechanical wood pulp is exposed to an enzymatic solution for a length of time selected such that brightness of subsequently refined pulp is at least maintained in comparison to subsequently refined pulp which has not been exposed to the enzymatic solution. Brightness (ISO) is determined according to standard TAPPI T 452 om-08. This maintenance of optical brightness can also be accompanied by the benefit of a reduction of energy consumption in a subsequent refining step of the enzymatically treated pulp.

The method of the invention has been demonstrated with the softwood Black Spruce, *Picea mariana*. Suitable wood fibers contain between 38 and 52% by weight cellulose, between 20 and 30% by weight lignin, between 20 and 30% by weight hemicelluloses (hemicellulose typically being from 15 to 20% mannans by total weight of the wood chips and from 15 to 20% xylans by total weight of the wood chips).

The invention includes a method for producing a paper product that includes the steps of: (a) introducing mechanical wood pulp into a vessel; (b) introducing into the vessel an enzymatic solution comprising an endoglucanase (EG), a cellbiohydrolase (CBH) and a mannanase (MAN) wherein the ratio of enzymatic activity of EG:CBH is at least 3, and the ratio of enzymatic activity of MAN:CBH is at least 1.5; (c) waiting a length of time sufficient for the freeness of the pulp to be reduced to a selected level of freeness of fibers in the pulp; and (d) making the paper product with the pulp produced, the paper having a tensile strength at least as great as paper produced from the mechanical wood pulp by the same method without exposure to said enzymatic solution.

The invention includes a method of manufacturing a wood pulp that includes the step of: exposing a mechanical wood pulp to an enzymatic solution comprising an endoglucanase (EG), a cellbiohydrolase (CBH) and a mannanase (MAN) wherein the ratio of enzymatic activity of EG:CBH is at least 3, and the ratio of enzymatic activity of MAN:CBH is at least 1.5, for a sufficient amount of time to reduce energy consumption during subsequent refining of the exposed pulp in comparison to energy consumption during refining of the same pulp which has not been exposed to the enzymatic solution while at least maintaining the tensile strength of a handsheet produced from said subsequently refined pulp in comparison with a handsheet produced from the same pulp which has not been exposed to the enzymatic solution, the tensile strength being determined according to TAPPI standard T 205 sp-06.

The present invention thus relates to methods for reducing the amount of energy required to refine reject pulp by treating said pulp with a solution containing enzymes and preferably some stabilizer compounds. Stabilizer agents and surfactants containing mainly propylene glycol, glycerol, sorbitol and to a lesser degree proxel, potassium sorbate and ethoxylated fatty alcohols can be used. The enzymatic treatment can be carried out at process temperatures of from 20° C. to 80° C., for example between 40° C. and 60° C. The enzymatic treatment can be carried out at a pH of from about 2 to about 10. The treatment time can be from 30 minutes to 10 hours. Other temperatures, pHs and or times can be used.

It is possible to maintain tensile strength although some loss of tear strength of refined pulp and resultant paper products was observed.

The enzyme solution preferably possesses the following relative activities: the EG should have a 10 fold greater activity than the CBH and the mannanase should have a 2 fold greater activity than the CBH. This enzyme solution is available commercially from Novozymes® under the name Celluclast 1.5L™.

Methods of refining pulp with lower energy requirements to obtain a desirable degree of refining are set forth herein. Methods for refining the pulp wherein the refining process includes treatment of the pulp with a complex enzyme mixture are presented, wherein the resultant pulp and/or paper products have maintained tensile strength, improved optical properties and slightly reduced tear index as compared to untreated pulps or products therewith.

Pulp and paper products made therefrom having maintained tensile strength, improved optical properties and slightly reduced tear strength are provided. Pulp and papers made therefrom which require less energy to produce are provided.

It is to be understood that both the foregoing general description and the following detailed description are exemplary and explanatory only and are only intended to provide a further explanation of the present invention as claimed

BRIEF DESCRIPTION OF THE DRAWINGS

Embodiments illustrating the invention and establishing feasibility of various aspects thereof are described below with reference to the accompanying drawings, in which.

DETAILED DESCRIPTION

Figure 1:
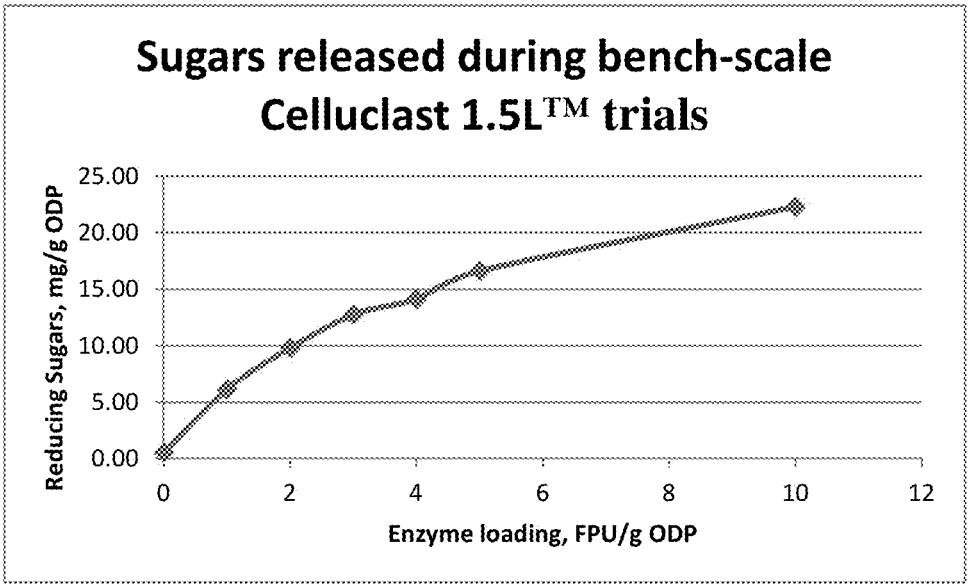
FIG. 1 is a graph showing the amount of sugars released per gram of oven dried pulp (ODP) into the liquor after a 1 hour enzyme hydrolysis at different dosages. Based on these results dosages (5 and 10 FPU/g ODP) were chosen for refining trials.

The present invention relates to a method of refining pulp, wherein the method includes the use of an enzyme mixture containing cellulases and hemicellulase. Treatment with this solution following primary defibering and selective screening prior to secondary reject or post refining can reduce the energy required to reach a given degree of refining. This enzyme mixture is to contain a significant EG activity, a marked mannanase activity and a CBH activity that is lower than the first two but not negligible.

As used herein, an endo-β-glucanase is preferably a cellulase classified as EC 3.2.1.6-endo-1,3(4)-β-glucanase. This enzyme is preferably capable of endohydrolysis of 1,3- or 1,4-linkages in β-D-glucans when the glucose residue whose reducing group is involved in the linkage to be hydrolysed is itself substituted at C-3. This hydrolysis cleaves the O-glycosyl bond of the cellulose backbone.

As used herein, a "mannanase" is preferably a hemicellulase classified as EC 3.2.1.78, and called endo-1,4-β-mannosidase. Mannanase includes β-mannanase, endo-1,4-mannanase, and galactomannanase. Mannase is preferably capable of catalyzing the hydrolysis of 1,4-β-D-mannosidic linkages in mannans, including glucomannans, galactomannans and galactoglucomannans. Mannans are polysaccharides primarily or entirely composed of D-mannose units.

As used herein, a cellobiohydrolase is preferably a cellulase classified as EC 3.2.1.91 and called cellulose 1,4-β-cellobiosidase (non-reducing end). This enzyme produces the hydrolysis of (1→4)-δ-D-glucosidic linkages in cellulose and cellotetraose, releasing cellobiose from the non-reducing ends of the chains EG activity can be determined following the carboxymethyl cellulose (CMC) method described in *Measurement of Cellulase Activities* by T. K. Ghose (Pure & Appl. Chem. Vol 69, No. 2, pp. 257-268, 1987). The amount of reducing sugars released from enzymatic hydrolysis of a 2% solution of a well characterized CMC is used to determine the enzymes EG activity. Sugar concentration is determined by the well known DNS method described by G. L. Miller (Analytical Chem., No. 31, p. 426, 1959).

CBH activity can be determined following the filter paper assay method described in *Measurement of Cellulase Activities* by T. K. Ghose (Pure & Appl. Chem. Vol 69, No. 2, pp. 257-268, 1987). The amount of reducing sugars released from enzymatic hydrolysis of Whatman No. 1 filter paper strip of known size is used to determine the enzyme's CBH activity. Sugar concentration is determined by the well known DNS method described by G. L. Miller (Analytical Chem., No. 31, p. 426, 1959).

Mannanase activity can be determined following the method described by M. Ratto and K. Poutanen (Biotechnology Letters, No 9, pp-661-664, 1988). The amount of reducing sugars released from enzymatic hydrolysis of a 0.5% solution of locust bean gum is used to determine the enzymes mannanase activity. Sugar concentration is determined by the well known DNS method described by G. L. Miller (Analytical Chem., No. 31, p. 426, 1959).

An enzyme solution containing EG, CBH and mannanase activities in the correct ratios is commercially available from Novozymes® under the name Celluclast 1.5L™. This solution contains between 40 mg and 50 mg of total protein per milliliter of solution. When kept at between 0° C. and 25° C., the solution is stable and its activity is maintained for about 18 months. Storage at higher temperatures will reduce this effective storage time.

The enzyme solution can vary slightly in ratio of activities which still give the desired energy reductions and paper qualities. The amount of total protein in the correct ratio should be between 0.02 kg and 10 kg per metric ton of oven dried wood. This amount of total protein can vary depending on the type of woody substrate being used, for example virgin hardwood kraft, virgin softwood kraft, recycled groundwood, refiner groundwood, pressurized refiner groundwood, thermomechanical, chemithermomechanical or a mixture thereof; or the species of wood which makes up this substrate, for example *Populus* sp., *Acer* sp., *Picea* sp., *Abies* sp., *Pinus* sp., *Conium* sp., etc.

The pulp of the present invention can be treated with one or more other components, including polymers such as anionic and non-ionic polymers, clays, other fillers, dyes, pigments, defoamers, microbiocides, pH adjusting agents such as alum or hydrochloric acid, other enzymes, and other conventional papermaking or processing additives. These additives can be added before, during or after introduction of the enzyme solution. The enzyme solution can be added, and is preferably added to the papermaking pulp before the addition of coagulants, flocculants, fillers and other conventional and non-conventional papermaking additives, including additional enzymes.

The pulp can be any conventional softwood or hardwood species used in mechanical pulp production, such as spruce, fir, hemlock, aspen, acacia, birch, beech, eucalyptus, oak and other softwood and hardwood species. The pulp can contain cellulose fibers in an aqueous medium at a concentration of at least 35% by weight based on the oven dried solids content of the pulp. The pulp can be, for example, virgin pulp (e.g. spruce, fir, pine, eucalyptus, and include virgin hardwood or virgin softwood), hardwood kraft, softwood kraft, recycled groundwood, refiner groundwood, pressurized refiner groundwood, thermomechanical, chemithermomechanical or mixtures thereof.

According to various embodiments, the papermaking system can include a primary refiner, a secondary refiner, a screen, a mixer, a latency and/or blend chest, and papermaking equipment, for example, screens. The papermaking system can also include metering devices for providing a suitable concentration of the enzyme composition or other additives to the flow of pulp. Valving, pumps, and metering equipment as known to those skilled in the art can also be used for introducing various additives described herein to the pulp.

According to one embodiment, the enzyme solution can be added to the pulp after the pulp leaves the first refiner (also known as the primary refiner) during the refining process. For example, the enzyme solution can be added before the second refiner (also known as the secondary refiner), after the second refiner, before the screen, after the screen, before the mixer, after the mixer, before the latency and/or blend chest, to the latency and/or blend chest. For example, the enzyme solution can be added after the second refiner, between the screen and the mixer, or after the mixer. Other additives as described can be added to the papermaking system as known to those skilled in the art.

The pulp can be treated with the enzyme solution when the pulp is at a temperature of from 10° C. to about 75° C., from about 30° C. to about 70° C., or from about 40° C. to about 60° C. The pulp can be at a pH of from 2 to 10, from about 4 to 7, or from 4.5 to 5.5. A treatment time can be from 10 minutes to about 10 hours, from about 30 minutes to about 5 hours or from 1 hours to 2 hours.

The enzyme treatment is carried out during the refining process, but before completion of the refining process. The enzyme treatment is carried out on "coarse pulp". A "coarse pulp" refers to a woody material used as the raw material of the mechanical pulp, which has been subjected to at least one mechanical refining process step. The term coarse pulp therefore encompasses, e.g. once refiner or ground pulp, twice refined or ground pulp, the reject pulp and/or long fiber fractions, and combinations thereof. Preferably, the enzyme treatment is carried out on once refined or ground pulp or the reject pulp. More preferably the enzyme solution is carried out on once refined or ground pulp, a screened long fiber pulp fraction and the reject pulp.

In another embodiment, the enzyme solution can be added at the latency chest in a refining operation. As an example, the enzyme solution can be added after screening and in the feedline before the latency chest. In this embodiment, the screened pulp is directed to a latency chest prior to a reject refiner. The pulp is then refined to desired specifications before being returned to the papermaking system stream.

The introduction of the enzyme solution can be made at one or more points and the introduction can be continuous, semi-continuous, batch, or combinations thereof.

According to various embodiments, the consistency of the pulp can be less than 20%, from about 1% to 15%, or from about 4% to 10%.

A pulp processed as described herein can exhibit maintained tensile strength, while suffering some loss of tear strength. Paper products made from the pulp also maintain tensile strength while losing some tear strength. The addition of the enzyme solution creates fiber weaknesses which allow the formation of shorter fibers but also enhance fiber fibrillation which is why tear is affected while tensile strength is maintained. Fines production increases, thus lowering freeness at a given specific energy of refining SEC. The addition of the enzyme solution to coarse pulp reduces the amount of SEC needed to obtain a desired level of freeness.

A pulp produced by the methods described herein can be used in the production of paper products, including, for example, cardboard, paper towels, newspaper, and hygiene products. The methods described herein can also be suitable for textile manufacturing.

EXAMPLES

Example 1

Enzymatic Activities

The commercial enzyme product, Celluclast 1.5L™, was tested for several enzymatic activities and was found to have several different types of activities. Table 1 list all relevant and significantly measurable activities and protein concentration.

Carboxymethyl cellulase (CMC) activity, equivalent to endo-β-glucanase activity, was determined following the CMC method described in *Measurement of Cellulase Activities* by T. K. Ghose (Pure & Appl. Chem. Vol 69, No. 2, pp. 257-268, 1987). The amount of reducing sugars released from enzymatic hydrolysis of a 2% solution of a well characterized CMC during a 30.0 minute hydrolysis at pH 4.8 and 50° C. is used to determine the enzymes EG activity. Sugar concentration is determined by the well known 3,5-dinitrosalicylic acid (DNS) solution method described by G. L. Miller (Analytical Chem., No. 31, p. 426, 1959). The addition of the DNS solution to the hydrolysis filtrate stops the reaction. The mixture was boiled for 5.0 minutes to allow for color formation. After cooling, the absorbency is measured at 540 nm and the concentration is determined against a standard curve.

Mannanase activity was determined following the method describer by M. Ratto and K. Poutanen (Biotechnology Letters, No 9, pp-661-664, 1988). The amount of reducing sugars released from enzymatic hydrolysis of a 0.5% solution of locust bean gum during a 30.0 minute hydrolysis at pH 4.8 and 50° C. is used to determine mannanase activity. Sugar concentration is determined by the well known DNS method described by G. L. Miller (Analytical Chem., No. 31, p. 426, 1959) and described thoroughly above.

Filter paper activity, equivalent to CBH activity, was determined following the filter paper assay method described in *Measurement of Cellulase Activities* by T. K. Ghose (Pure & Appl. Chem. Vol 69, No. 2, pp. 257-268, 1987). This method uses the amount of reducing sugars released from enzymatic hydrolysis of Whatman No. 1 filter paper strip of known size during a 30.0 minute hydrolysis at pH 4.8 and 50° C. to determine the enzymes CBH activity. Sugar concentration is determined by the well known DNS method described by G. L. Miller (Analytical Chem., No. 31, p. 426, 1959) and described thoroughly above.

Protein concentration was determined using the Bradford assay. Bradford assay kits purchased from Sigma-Aldrich were used. This well known method uses the binding of protein with a solution of Coomassie Blue which allows colorimetric determination of protein concentration based on a standard curve produced using bovine serum albumin. Absorbency is measured at 595 nm.

TABLE 1

Measured parameters of Celluclast 1.5L ™

| Parameter | Value | Unit |
|---|---|---|
| Endo-β-glucanase | 1860 | CMC/ml |
| Mannanase activity | 285 | IU/ml |
| Cellobiohydrolase | 150 | FPU/ml |
| Total protein | 43.4 | mg/ml |

Example 2

Sugars Released

The enzyme solution was added to a TMP reject pulp (5 g ODP) using the solution's filter paper activity as a dosage indicator. Several dosages (5 and 10 FPU/g ODP), chosen based on reducing sugar results, and a control were done in duplicate and measured in duplicate for a total of four data sets. Hydrolysis was carried out at a consistency of 10%, a temperature of 50° C. and a time of 1 hour. After which, the samples were filtered and the filtrate was treated using the well known 3,5-dinitrosalicylic acid (DNS) solution method described by G. L. Miller (Analytical Chem., No. 31, p. 426, 1959). The addition of the DNS solution to the hydrolysis filtrate stops the reaction. The mixture was boiled for 5.0 minutes to allow for color formation. After cooling, the absorbency is measured at 540 nm and the concentration is determined against a standard curve. This is shown in FIG. 1 from the data in Table 2.

TABLE 2

Sugars released during bench-scale Celluclast 1.5L ™ trials

| Enzyme dosage (FPU/g oven dried pulp) | Sugars released into liquor (mg/g ODP) | Standard deviation (mg/g ODP) |
|---|---|---|
| 0 | 0.54 | 0.01 |
| 1.0 | 6.13 | 0.06 |
| 2.0 | 9.79 | 0.11 |
| 3.0 | 12.74 | 0.16 |
| 4.0 | 14.15 | 0.19 |
| 5.0 | 16.62 | 0.03 |
| 10.0 | 22.31 | 0.05 |

Example 3

Freeness

Figure 2:
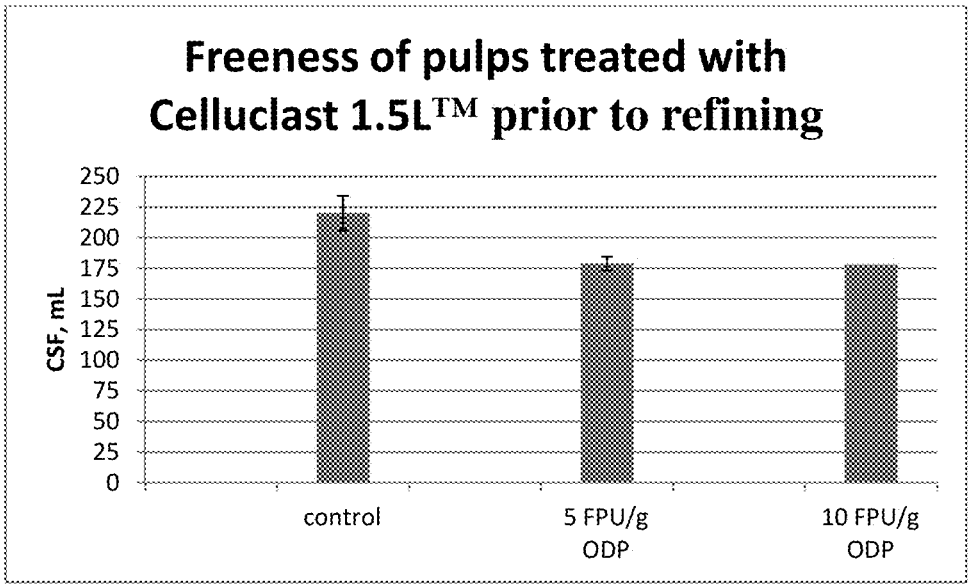
FIG. 2 is a bar graph showing the freeness of pulps obtained after the enzymatically treated pulps were refined under the same conditions of feed speed, plate gap and consistency.

The enzyme solution was added to a TMP reject pulp (200 g ODP) using the solution's filter paper activity as a dosage indicator. Two dosages (5 and 10 FPU/g ODP), chosen based on reducing sugar results, and a control were done in duplicate. Hydrolysis was carried out at a consistency of 4%, a temperature of 50° C. and a time of 1 hour. After this treatment, pulp was dewatered to 20% consistency and refined in a KRK refiner with a disc gap of 0.10 mm. Refined pulp was collected and moisture was checked prior to measuring Canadian Standard Freeness (CSF). Results are shown in the Table 3 and FIG. 2.

TABLE 3

Freeness of pulp treated with Celluclast 1.5L ™ trials before refining

| Enzyme dosage (FPU/g oven dried pulp) | Average CSF (ml) | Standard deviation (ml) |
|---|---|---|
| Control (0 FPU/g ODP) | 220 | 14 |
| 5 | 179 | 6 |
| 10 | 178 | 0 |

Example 4

Energy Savings

The enzyme solution was added to a TMP reject pulp (200 g ODP) using the solution's filter paper activity as a dosage indicator. Two dosages (5 and 10 FPU/g ODP), chosen based on reducing sugar results, and a control were done in duplicate. Hydrolysis was carried out at a consistency of 4%, a temperature of 50° C. and a time of 1 hour. After this treatment, pulp was dewatered to 20% consistency and refined in a KRK refiner with a disc gap of 0.10 mm. Energy consumption was monitored with an online monitor and networked computer. Results are shown in Table 4.

TABLE 4

Specific Energy Consumption needed to refine pulp treated with Celluclast 1.5L ™ to approximately 200 ml freeness

| Enzyme loading (FPU/g) | Meter reading (kWh) | Net SEC* (kWh/t) | Average SEC (kWh/t) | Energy Saving (%) |
|---|---|---|---|---|
| 0 | 0.503 | 1892.2 | 1962.2 | 0 |
| 0 | 0.531 | 2032.2 | | |
| 5.0 | 0.462 | 1687.2 | 1702.2 | −13.5 |
| 5.0 | 0.468 | 1717.2 | | |
| 10.0 | 0.425 | 1502.2 | 1524.7 | −22.3 |
| 10.0 | 0.434 | 1547.2 | | |

*No-load energy consumption (3 minutes of warm-up energy was calculated to be 0.12456 kWh) was subtracted from the meter reading to give the net energy consumption

Example 5

Fiber Properties

Figure 3:
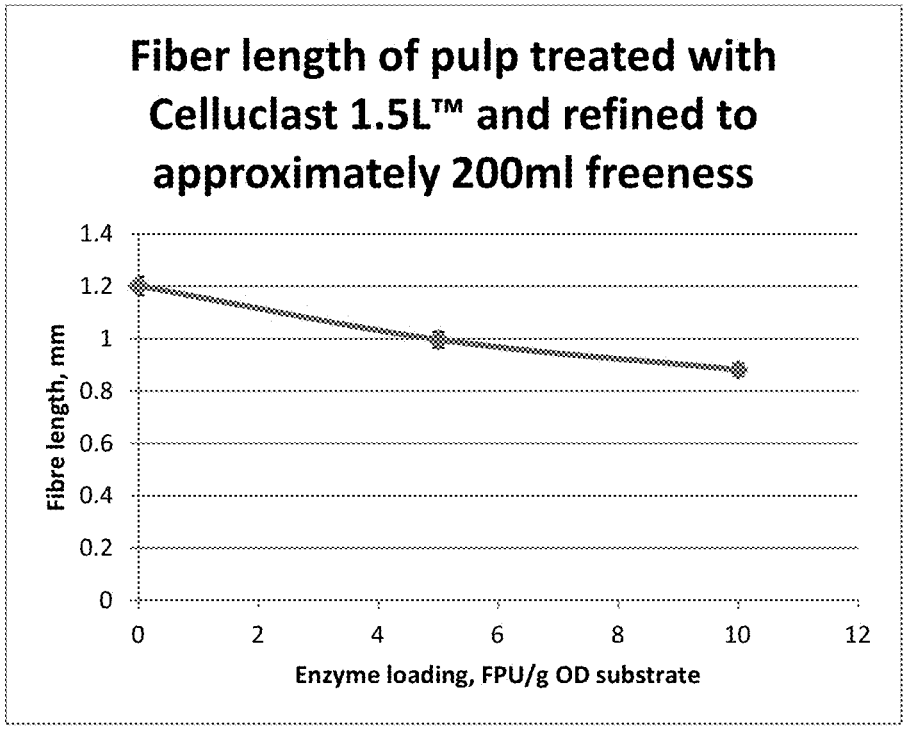
FIG. 3 is a plot showing percent decrease in fiber length with dosage, after enzymatically treated pulps were refined.
Figure 4:
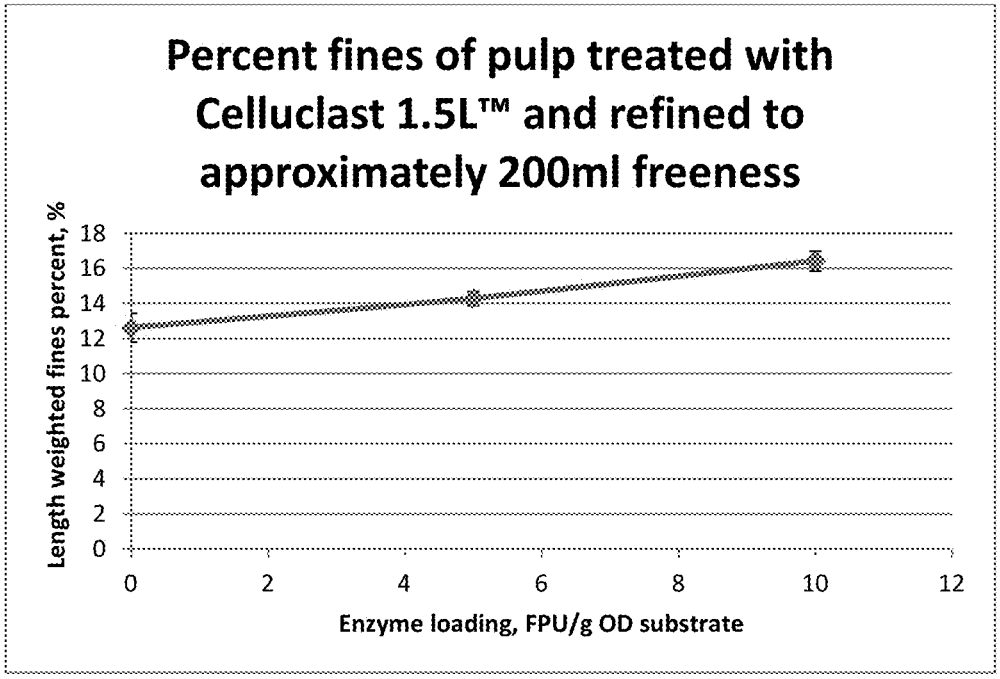
FIG. 4 is a plot showing percent increase in fines with dosage, after enzymatically treated pulps were refined.
Figure 5:
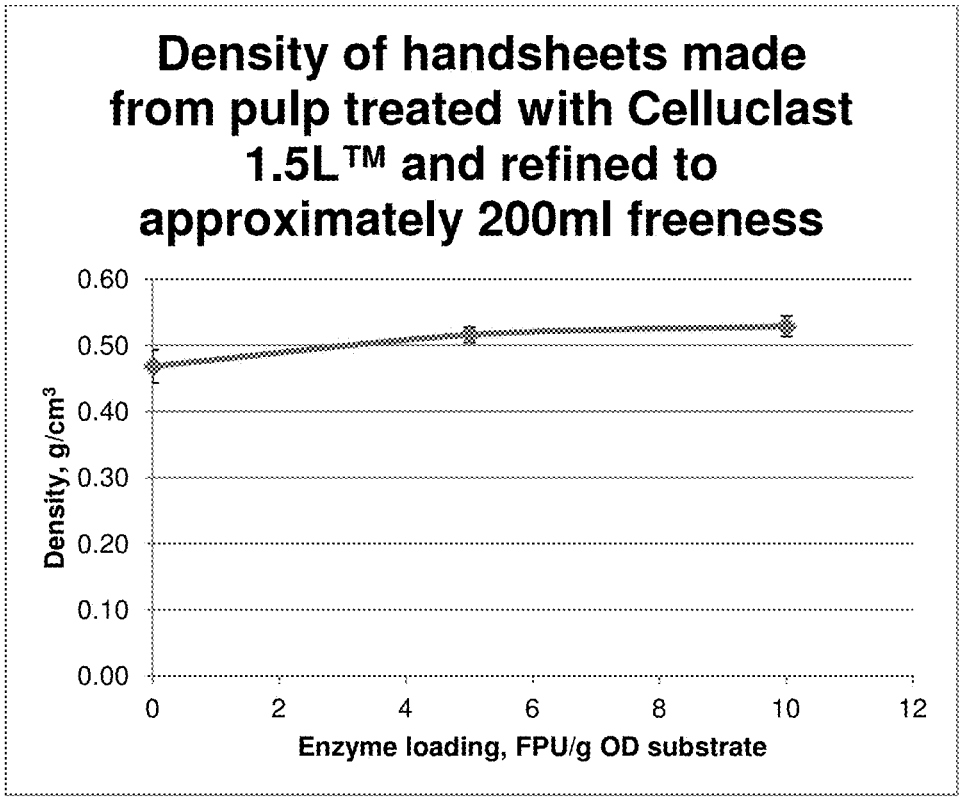
FIG. 5 is a plot showing handsheet density as function of enzymatic loading, of handsheets made from enzymatically treated refined pulps.
Figure 6:
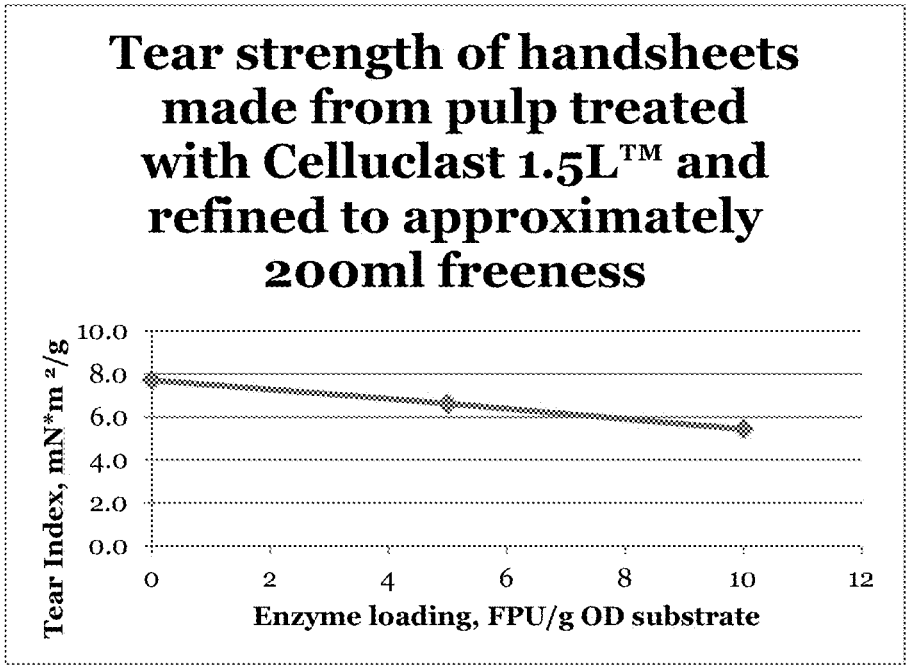
FIG. 6 is a plot showing tear strength as a function of enzymatic loading, of handsheets made from enzymatically treated refined pulps.
Figure 7:
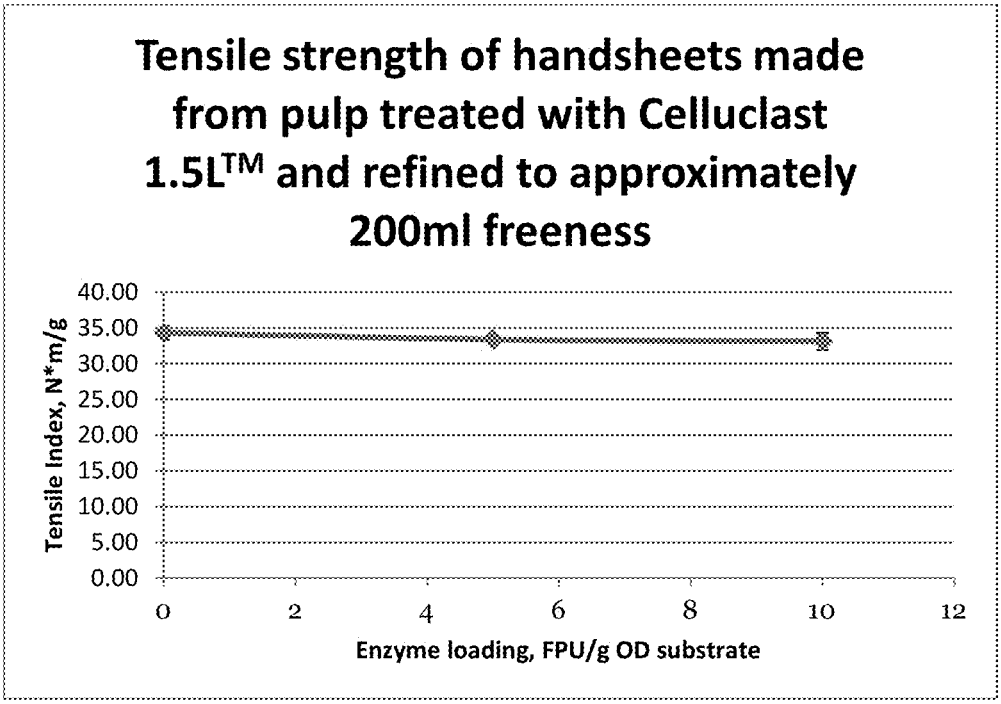
FIG. 7 is a plot showing tensile strength as a function of enzymatic loading, of handsheets made from enzymatically treated refined pulps.
Figure 8:
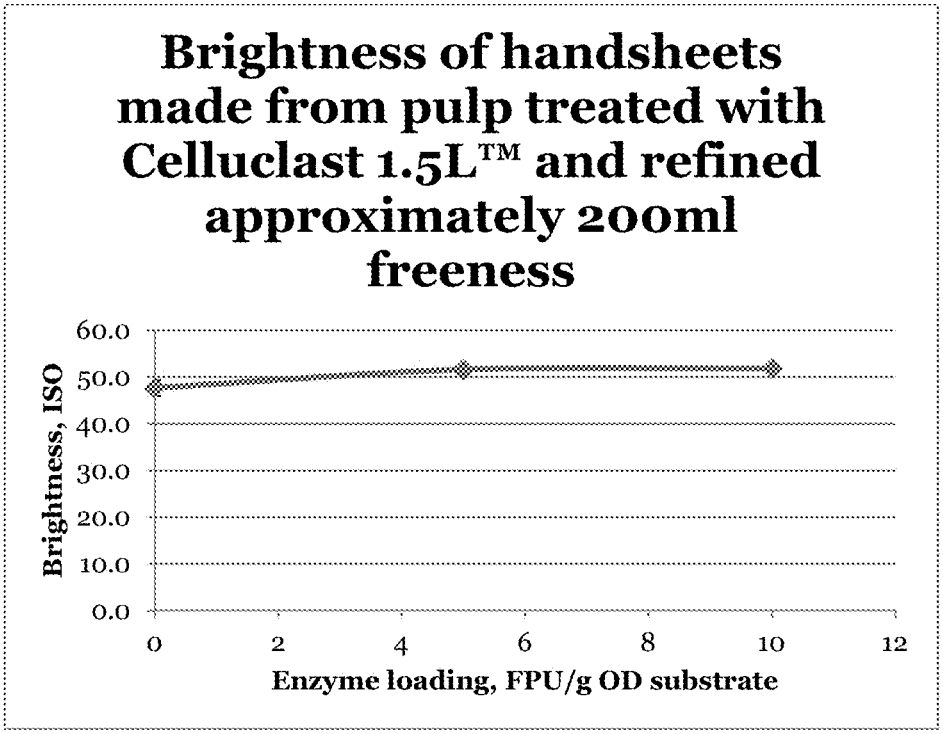
FIG. 8 is a plot showing brightness as a function of enzymatic loading of handsheets made from enzymatically treated refined pulps.

The enzyme solution was added to a TMP reject pulp (200 g ODP) using the solution's filter paper activity as a dosage indicator. Two dosages (5 and 10 FPU/g ODP), chosen based on reducing sugar results, and a control were done in duplicate. Hydrolysis was carried out at a consistency of 4%, a temperature of 50° C. and a time of 1 hour. After this treatment, pulp was dewatered to 20% consistency and refined in a KRK refiner with a disc gap of 0.10 mm. Energy consumption was monitored with an online monitor and networked computer. Refined pulp was collected and moisture was checked prior to testing fiber properties with a Fiber Quality Analyzer. Results are shown in Table 5 and in FIGS. 3 and 4.

TABLE 5

Some fiber properties of pulp treated with Celluclast 1.5L ™ and refined to approximately 200 ml freeness

| Enzyme loading (FPU/g oven dried pulp) | Mean length weighted fiber length (mm) | Mean length weighted fines percent (%) |
|---|---|---|
| Control (0 FPU/g ODP) | 1.202 ± 0.035 | 12.63 ± 0.82 |
| 5 | 0.997 ± 0.030 | 14.29 ± 0.39 |
| 10 | 0.882 ± 0.024 | 16.43 ± 0.56 |

Example 6

Handsheet Properties

The enzyme solution was added to a TMP reject pulp (200 g ODP) using the solution's filter paper activity as a dosage indicator. Two dosages (5 and 10 FPU/g ODP), chosen based on reducing sugar results, and a control were done in duplicate. Hydrolysis was carried out at a consistency of 4%, a temperature of 50° C. and a time of 1 hour. After this treatment, pulp was dewatered to 20% consistency and refined in a KRK refiner with a disc gap of 0.10 mm. Energy consumption was monitored with an online monitor and networked computer. Refined pulp was collected and moisture was checked prior to preparing handsheets following TAPPI standard T 205 sp-06. Results are shown in Table 6 and in FIGS. 5, 6, 7 and 8.

TABLE 6

Handsheet properties of paper made from pulp treated with Celluclast 1.5L ™ and refined to approximately 200 ml freeness

| Enzyme loading (FPU/g oven dried pulp) | Mean density (g/cm$^3$) | Mean Tear Index (mN*m$^2$/g) | Mean Tensile Index (N*m/g) | Mean Brightness (ISO) |
|---|---|---|---|---|
| Control (0 FPU/g ODP) | 0.47 ± 0.02 | 7.71 ± 0.11 | 34.33 ± 0.99 | 47.63 ± 1.66 |
| 5 | 0.52 ± 0.01 | 6.62 ± 0.20 | 33.39 ± 0.54 | 51.62 ± 0.22 |
| 10 | 0.53 ± 0.02 | 5.43 ± 0.17 | 33.12 ± 1.20 | 51.85 ± 0.91 |

All patents, applications and publications mentioned above and throughout this application are incorporated in their entirety by reference herein.

What is claimed is:

1. A method of manufacturing a wood pulp, the method comprising:

exposing a mechanical wood pulp comprising an at least once refined mechanical raw wood pulp to an enzymatic solution comprising an endoglucanase (EG), a cellbiohydrolase (CBH) and a mannanase (MAN), wherein the ratio of enzymatic activity of EG:CBH is at least 3 and the ratio of enzymatic activity of MAN:CBH is at least 1.5, and the enzymatic activity of the CBH is at least 0.05 FPU and up to 10 FPU per gm of the long-fiber fraction of the pulp based on dry weight measured according to standard T 258 om-06 for an amount of time up to about 5 hours and sufficient to reduce energy consumption during subsequent refining of the exposed pulp in which the freeness of the pulp (CSF) is reduced to below 150 ml and by at least 10% in comparison to the freeness of the same pulp which has not been exposed to the enzymatic solution while at least maintaining the tensile strength of a handsheet produced from said subsequently refined pulp in comparison with a handsheet produced from the same pulp which has not been exposed to the enzymatic solution, the tensile strength being determined according to TAPPI standard T 205 sp-06.

2. The method of claim 1, wherein said reduction in energy consumption is at least 10%.

3. The method of claim 2, wherein said reduction in energy consumption is at least 20%.

4. The method of claim 3, wherein the step of exposing the mechanical wood pulp comprises exposing a mechanical wood pulp having a CSF of greater than 650 ml to the enzymatic solution.

5. The method of claim 4, wherein the enzymatic activity of the EG is in the range of 0.5 to 25 CMCU per gm of the long-fiber fraction of the pulp based on dry weight measured according to standard T 258 om-06.

6. The method of claim 5, wherein the enzymatic activity of the CBH is at least 0.5 FPU per gm of the long-fiber fraction based on dry weight measured according to standard T 258 om-06.

7. The method of claim 6, wherein the step of exposing the mechanical wood pulp is conducted for a sufficient length of time to increase the amount of fines in subsequently refined pulp by at least 10% in comparison to subsequently refined pulp which has not been exposed to the enzymatic solution.

8. The method of claim 7, wherein the length of time to which the mechanical wood pulp is exposed to the enzymatic solution is selected to preclude the change in tear index of a handsheet produced from said subsequently refined pulp to no more than a decrease of 15% in comparison to the tear index of a handsheet produced from the same pulp which has not been exposed to the enzymatic solution.

9. The method of claim 8, wherein the length of time to which the mechanical wood pulp is exposed to the enzymatic solution is selected such that brightness of subsequently refined pulp is at least maintained in comparison to subsequently refined pulp which has not been exposed to the enzymatic solution.

10. The method of claim 9, wherein the mechanical wood pulp comprises softwood, the softwood comprising between 38 and 52% by weight cellulose, between 20 and 30% by weight lignin, between 20 and 30% by weight hemicellulose.

11. The method of claim 10, wherein said EG is classified as EC 3.2.1.6, said CBH is classified as EC 3.2.1.91, and said MAN is classified as EC 3.2.1.78.

12. The method of claim 11, wherein the ratio of enzymatic activity of EG:CBH is at least 10.

13. The method according to claim 12, wherein the mechanical wood pulp exposed to the enzymatic solution has a consistency of between 1 and 20%.

14. A method for producing a paper product comprising the steps of: (a) introducing an at least once refined mechanical wood pulp into a vessel; (b) introducing into the vessel an enzymatic solution comprising an endoglucanase (EG), a cellbiohydrolase (CBH) and a mannanase (MAN) wherein the ratio of enzymatic activity of EG:CBH is at least 3, the ratio of enzymatic activity of MAN:CBH is at least 1.5, and the enzymatic activity of the CBH is at least 0.5 FPU and up to 10 FPU per gm of the long-fiber fraction of the pulp based on dry weight measured according to standard T 258 om-06; and (c) waiting a length of time up to about 5 hours and sufficient to reduce energy consumption during subsequent refining of the pulp in which the freeness of the pulp (CSF) is reduced to below 150 ml and by at least 10% in comparison to the freeness of the same pulp which has not been exposed to the enzymatic solution; and (d) making the paper product with the pulp produced, the paper having a tensile strength at least as great as paper produced from the mechanical wood pulp by the method without exposure to said enzymatic solution.

* * * * *